United States Patent [19]

Walton

[11] 3,968,945

[45] July 13, 1976

[54] SHAPED MINI CHARGE ROUND

[75] Inventor: John E. Walton, Camillus, N.Y.

[73] Assignee: The United States of America as represented by the Secretary of the Army, Washington, D.C.

[22] Filed: July 11, 1974

[21] Appl. No.: 487,359

[52] U.S. Cl. ..... 244/3.28; 102/56 SC; 102/76 R

[51] Int. Cl.[2] ..... F42B 13/10; F42B 13/32

[58] Field of Search ..... 102/56 SC, 71, 72, 76; 244/3.28

[56] References Cited

UNITED STATES PATENTS

| | | | |
|---|---|---|---|
| 1,047,862 | 12/1912 | Voller | 102/72 |
| 1,296,403 | 3/1919 | Kindle | 244/3.28 |
| 3,855,933 | 12/1974 | Messineo | 102/56 SC |

*Primary Examiner*—Verlin R. Pendegrass
*Attorney, Agent, or Firm*—Nathan Edelberg; Robert P. Gibson; Charles R. Carter

[57] ABSTRACT

A mini charged round utilizing a low speed, fin stabilized structure with a warhead having a shaped charge for destroying incoming motar, rocket and artillery rounds. The charged round is provided with a delay ignitor which insures detonation of the main primer in the event of missing the target.

2 Claims, 2 Drawing Figures

SHAPED MINI CHARGE ROUND

DEDICATORY CLAUSE

The invention described herein was made in the course of or under a contract or subcontract thereunder with the Government and may be manufactured, used, and licensed by or for the Government for governmental purposes without the payment to me of any royalties thereon.

BACKGROUND OF THE INVENTION

This invention relates to the field of missile detonation. Existing rounds used for destroying incoming motar, rocket and artillery rounds having an inherent disadvantage of requiring high speed as well as being a solid kinetic energy round. These requirements have caused problems in reliable ignition of the main primer and possible falling danger to friendlies.

SUMMARY OF THE INVENTION

The present invention has overcome this disadvantage by utilizing a round requiring a lower impact velocity while having a greater impact angle tolerability. The invention also provides for self destruction of the round in the event of missing the target. This is achieved by the use of a single inertia weight stabber to initiate delay and main charges.

This invention may be better understood from the following detailed description taken in conjunction with the accompanying drawing.

DESCRIPTION OF THE PREFERRED EMBODIMENT

Figure 1:
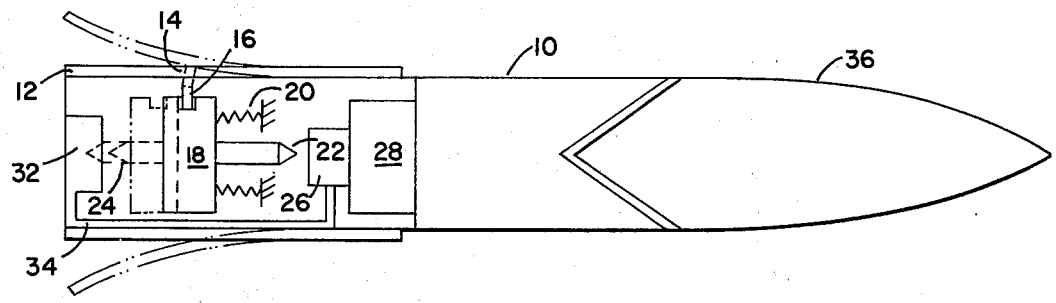
FIG. 1 is a diagrammatic side view of the round.
Figure 2:
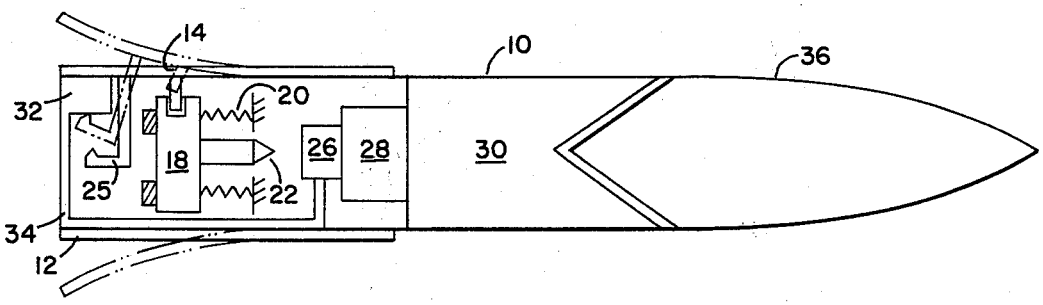
FIG. 2 is a diagrammatic side view of a modified delay ignitor.

Reference numeral 10 indicates a round case which when carried by a missile warhead, not shown, has spring fins 12 held in the stowed position by adjoining rounds or interstitial baffles. In the stowed position one of the fins has a pin 14 that enters a recess 16 in a slidable inertia block 18. A compression spring 20 exerts a force on the block tending to move the block rearwardly. However the engagement of pin 14 in recess 16 prevents any axial movement of the block. The blocks of the rounds shown are provided wih a forward stabber 22 and the block shown in FIG. 1 also has a rear delay stabber 24 mounted thereon. In FIG. 2 the rear delay stabber 25 is mounted on a fin 12. The round ignition system of both modifications includes a primer 26, a booster 28, a charge 30, a delay charge 32 and a delay charge path 34. Sufficient time delay is provided by path 34 to allow impact with a target. However after this time delay period the delay charge causes detonation of the main primer and self destruction of the round.

Upon impact with a target block 18 moves forward by inertia and carries stabber 22 to strike primer 26, booster 28 and charge 30. The charge detonates and forms a hot, high pressure, high velocity plasma jet with cone 36 which impinges upon the target. The action of the plasma jet penetrating the target case and contacting the charge detonates the target. Or, if the plasma jet produces high internal stresses within the case to cause internal spalling, charge detonation should occur. If the round misses the target the delay charge 32 which was ignited at projectile launch as shown in FIG. 1 by released stabber 24 by the action of spring 20, will initiate the explosive chain. In FIG. 2 the charge is struck and ignited by stabber 25 which is actuated by fin 12.

I claim:

1. A mini charged round having a shaped charge for destroying incoming mortar, rocket and artillery shells, said round comprising: a case having a plurality of spring fins attached on the outside thereof; an inertia block mounted for axial movement within said case; means for exerting a force on said block; said block being provided with a recess therein; a locking pin attached to one of said fins for entering said recess and preventing axial movement of said block; said round including a charge and means for igniting said charge positioned forward of said block; means carried by said block for striking said ignition means; delay ignition means in said case and means for striking and igniting said delay ignition means, said means for igniting said delay ignition being a striker carried on the rear side of said block.

2. A mini charged round having a shaped charge for destroying incoming mortar, rocket and artillery shells, said round comprising: a case having a plurality of spring fins attached on the outside thereof; an inertia block mounted for axial movement within said case; means for exerting a force on said block; said block being provided with a recess therein; a locking pin attached to one of said fins for entering said recess and preventing axial movement of said block; said round including a charge and means for igniting said charge positioned forward of said block; means carried by said block for striking said ignition means; delay ignition means in said case and means for striking and igniting said delay ignition means, said means for igniting said delay ignition being a striker mounted on a fin and actuated thereby.

* * * * *